United States Patent [19]

Underwood

[11] 3,971,526

[45] July 27, 1976

[54] TEXTILE SPOOL

[76] Inventor: Robert H. Underwood, 19 Stacy St., Saco, Maine 04072

[22] Filed: June 2, 1975

[21] Appl. No.: 582,716

[52] U.S. Cl. ..... 242/118.6; 242/118.62

[51] Int. Cl.[2] ..... B65H 75/10

[58] Field of Search ..... 242/118.62, 118.61, 242/118.6, 118.5, 118.4, 118

[56] References Cited

UNITED STATES PATENTS

| | | | |
|---|---|---|---|
| 1,769,416 | 7/1930 | Clinton | 242/118.6 |
| 2,086,948 | 7/1937 | Schwartz | 242/118.62 |
| 2,986,357 | 5/1961 | Foote | 242/118.6 |

FOREIGN PATENTS OR APPLICATIONS

| | | | |
|---|---|---|---|
| 642,280 | 8/1950 | United Kingdom | 242/118.6 |

*Primary Examiner*—Edward J. McCarthy
*Attorney, Agent, or Firm*—Richard P. Crowley

[57] ABSTRACT

An improved textile or jack spool for the winding and unwinding of filament material thereon, which spool is easily assembled and disassembled, and which spool comprises a hollow tube to carry the filament material, end flanges, hollow cylinders inserted at each end of the hollow tube, the cylinders having tapered internal surfaces at the interior ends, and shaft elements extending axially inwardly from each end of the hollow tube and through the flange elements within the interior of the hollow cylinders, the shaft elements having a tapered plug element within the hollow cylinders, the tapered surface of the plug adapted to mate with the internal tapered surface of the hollow cylinders, whereon, on an axial movement of the tapered plug in relationship to the tapered internal surface of the hollow cylinders, the flange elements at each end of the spool may be easily assembled and disassembled.

19 Claims, 4 Drawing Figures

TEXTILE SPOOL

BACKGROUND OF THE INVENTION

Textile spools for the carrying of filament material comprise a hollow tube with large-diameter end flanges secured to each end thereof, and are known as jack spools. Such jack spools include a pair of shafts which extend from each end of the tube, and which shafts are adapted to be placed in means to provide for the winding or unwinding of filament onto or from the hollow tube. The hollow tube commonly comprises a reinforced cardboard tube. After winding of a filament material onto the hollow tube, the jack spool, with the material thereon, is removed and unwound. However, after a portion of the filament material has been unwound, the residue is often found to be tangled, and the present practice is to employ a sharp cutting knife to cut the residual or tangled filament material from the hollow tube, so that the hollow tube may be reused in the winding/rewinding process. After a period of use, the hollow tube, due to the damage inflicted by the cutting knife, must be discarded. Further, the employment of a cutting knife for the removal of the residual filament material constitutes a safety hazard to the user.

It is desirable to have a means of quickly and effectively removing the flange elements from the hollow tubes so that the hollow tubes with the filament material may be kept or be easily removed for reuse.

U.S. Pat. No. 2,986,357, issued May 30, 1961, is directed to a textile spool or a collapsible jack spool which is designed for ease in assembly and disassembly. In practice, it has been found that workers using such spool must resort to the use of a cutting knife to remove residual filament material therefrom, with the result that the hollow tubes have a relatively short production life.

SUMMARY OF THE INVENTION

My invention relates to an improved textile spool, and in particular to an improved jack spool which may be easily assembled and disassembled for the removal and replacement of the hollow tube adapted to carry a filament material, and to the process of assembling and disassembling such improved spool.

My improved textile or jack spool may be easily assembled and disassembled, and provides the advantage that a cutting knife need not be employed to remove residual or tangled filament material on the spool, so that the hollow tube may be continuously reused, causing a considerable saving, as well as reducing the safety hazards involved in the use of a cutting knife. In addition and importantly, my improved textile spool provides for a means by which the large-diameter end flange elements may be quickly removed or assembled onto a hollow tube, so that the hollow tube may be placed in production in a fast and efficient manner, or shipped without the end elements carrying the filament material.

My improved textile spool comprises in general a hollow tube and flanges at each end of the hollow tube, a hollow thin wall cylinder at each end of the hollow tube and inserted therein, the internal diameter of the cylinder at the exterior end thereof within the tube having a peripheral, internally tapered surface, and a pair of shaft elements extending axially from the hollow tube through the end flange elements at one end and the other end, and positioned within the hollow cylinder. The shaft elements have a plug element at the other end, each plug element having a tapered, peripheral, external surface which is adapted to mate with the oppositely tapered surface of the hollow cylinder when in an assembled position in the tube. Fastening means at each end are provided to place the cylinders and shaft elements in an assembled position and a disassembled position for the removal of the end flanges when the fastening means are loosened.

In my preferred embodiment, which is described more particularly in the drawings, a pair of hollow cylinders and the tapered plug elements are employed at each end of the hollow tube; although it is recognized that, for the removal of the hollow tube, only one end of the spool need have my cylinder and shaft elements.

My improved textile spool, when in the assembled position, provides for the plug element to be engaged in a close relationship with the interior end of the cylinder and to expand the cylinder end so that it is forced against the inside diameter of the tube to hold it in place. Expansion of the cylinder end is accomplished by outward axial movement of the shaft; i.e., by tightening the fastening means, so that the tapered surface of the plug may expand slightly the end of the cylinder.

The spool is easily disassembled and the tube removed by an inward axial movement of the shaft to relieve the expansion pressure on the internal wall of the cylinder by loosening or removing the fastening means at that end. In one embodiment described, the plug element is tensionally positioned so that it moves readily inwardly through means of a coiled spring on loosening of the fastening means. Disassembly may be accomplished by loosening only one end of the spool, and then sliding the tube off of the nonexpanded cylinder.

My invention will be described for the purpose of illustration only in connection with certain preferred embodiments. However, it is recognized that various modifications and changes in the meaning and scope of my invention may be made in the embodiment as described.

DESCRIPTION OF THE EMBODIMENTS

Figure 1:
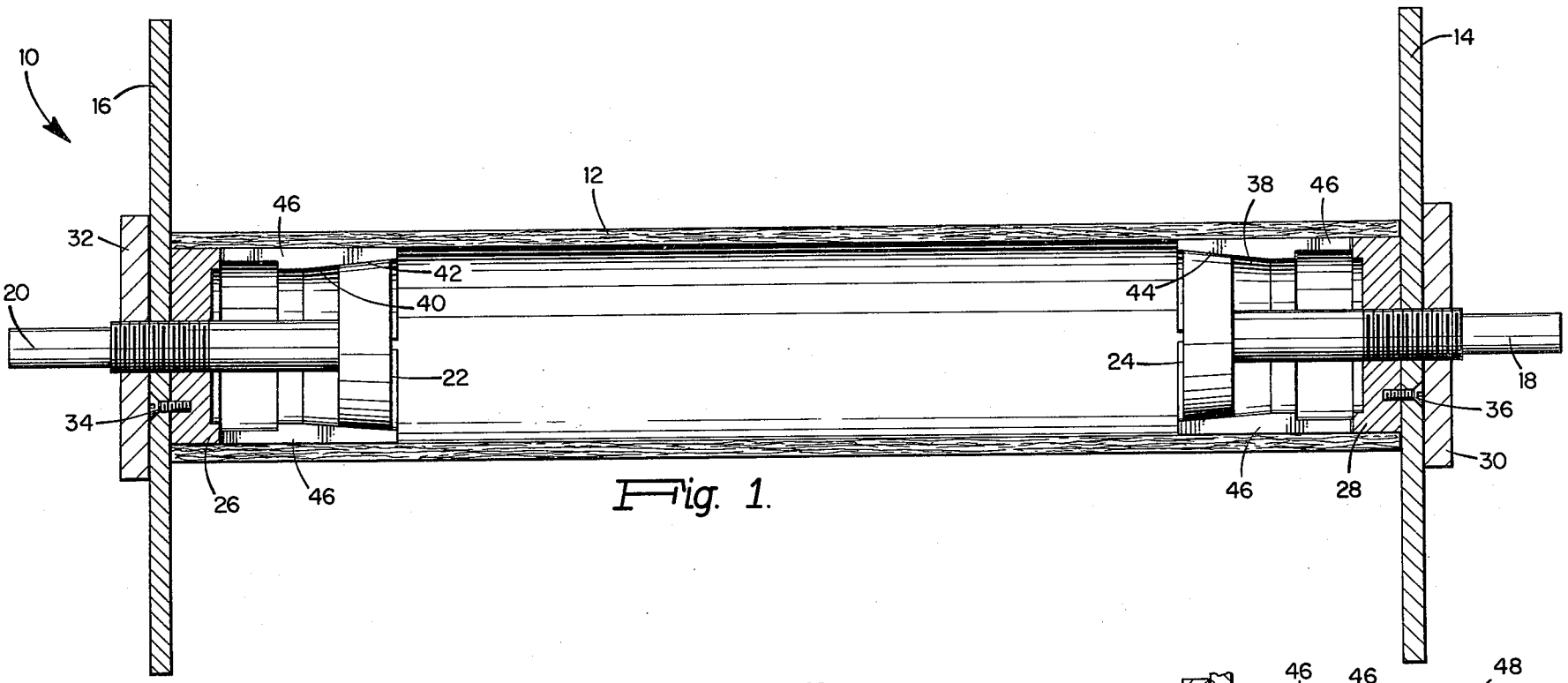
FIG. 1 is an illustrative cross-sectional view of my improved textile spool in an assembled condition.

My improved textile spool shown generally at 10 comprises a reinforced cardboard hollow tube 12, end flanges 14 and 16 of oil-impregnated hard wood, a pair of shafts 18 and 20 partially threaded and extending outwardly from the end flanges 14 and 16 at the one end, with the ends of the shafts 18 and 20 adapted to be placed in mounting or other means (not shown) to provide for a rotary motion of the shaft during a winding or unwinding operation. The other end of the shafts 18 and 20 comprises plug elements 22 and 24, the peripheral circumferential exterior surface of the plugs 22 and 24 being a tapered surface 42 and 44; for example, having a slight taper of about 5 degrees. Hollow thin wall cylinders 26 and 28 are shown inserted into the ends of the tube element 12, with the cylinder secured at the ends and in a locking engagement with the end flanges 14 and 16 through threaded locking bolts 34 and 36 at each end.

The inner diameter surfaces 38 and 40 of the cylinders 26 and 28 are tapered at the end thereof, so that they may be matingly engaged with the tapered surfaces 42 and 44 of the plugs 22 and 24, the taper being of such size so as to permit the plug elements 22 and 24, when moved axially and outwardly from the tube 12; that is, when tightened through the employment of nuts 30 and 32, to force the tapered surface of the plugs into a close-fitting, tight relationship with the corresponding tapered surfaces 38 and 40 of the cylinders 26 and 28, and to expand the ends of the cylinders 26 and 28 into a close-holding relationship with the interior of the tube 12. The tapered mating surfaces of the plug and cylinder are the preferred embodiment, since the differently tapered surfaces permit ease in assembling and disassembling. However, any means to expand and contract the cylinder, particularly the ends, may be employed, such as making only one surface of either the plug or cylinder tapered. If desired, holes may be placed in each fastening nut 30 and 32 to permit rapid assembly and disassembly of the spool by the use of a spanner wrench.

My spool is illustrated in its assembled or use condition. The assembly of my spool is accomplished by assembling the cylinder 26, the shaft 20, the flange 16 and threaded nut 32 together, and doing likewise with the corresponding cylinder 28, the shaft 18, and flange 14 and the nut 30. Each of these assemblies is then inserted into one end of the hollow tube 12, then holding onto the flange 14 with one hand, a spanner wrench is inserted into holes in the fastening nuts 30 and 32, or other wrench used, and the nuts rotated by the use of the wrench until the corresponding shafts 18 and 20 are drawn securely against the inside diameter peripheral surfaces 38 and 40 of the cylinders 26 and 28 through the axial outward movement of the plugs 22 and 24, so as to expand the cylinders 26 and 28 against the inside diameter of the hollow tube 12. The textile spool is then in the assembled condition, and may be employed for the carrying of filament material through rotation of the spool about the shaft elements 18 and 20.

Disassembly of the spool is easily and rapidly accomplished by holding the flange element and inserting a spanner wrench into the holes of the nut and rotating the nut until it is free on the shaft. A tap on the end of the shaft releases the pressure of the cylinder against the inside diameter of the hollow tube 12 by axially moving the tapered plug surfaces 42 and 44 out of engagement with the tapered surfaces 38 and 40 of the cylinders, and permits the cylinders 26 and 28 to be easily removed from one or both ends of the hollow tube 12.

Figure 3:
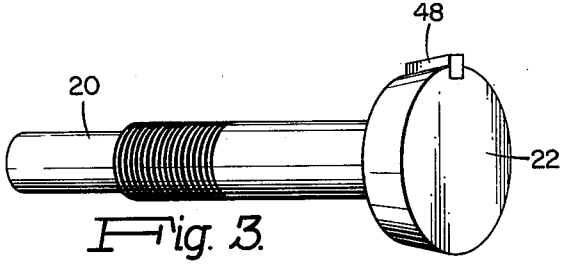
FIG. 3 is a perspective view of a modified shaft for use in my textile spool.
Figure 2:
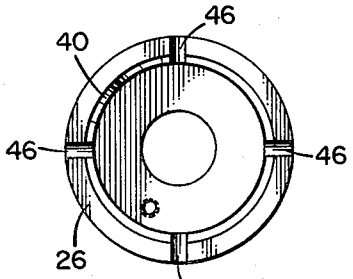
FIG. 2 is an end elevation view of my improved textile spool cylinder.

FIG. 3 illustrates another embodiment of my invention wherein the tapered peripheral surface of the plug has a raised key element thereon 48, which key element fits into a slot 46 on the end of the cylinder. The key 48 is adapted to fit into the slot 46 in the cylinder, and prevents the shaft from turning when drawn into the cylinder in the assembled condition.

Figure 4:
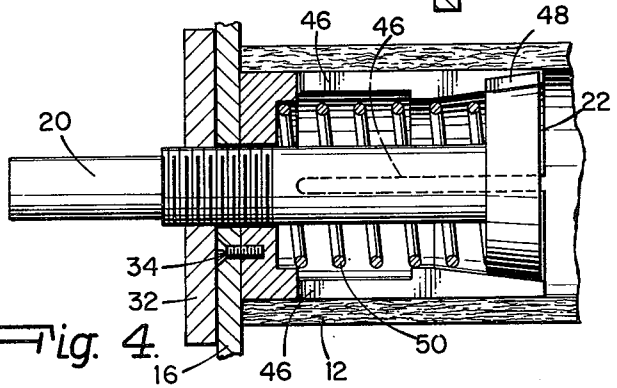
FIG. 4 is a cross-sectional view of a modified shaft and cylinder arrangement in my textile spool.

FIG. 4 shows a coiled spring 50 which surrounds the shaft element within the cylinder so as to aid in the release of tension against the inside diameter of the cylinder when the outer fastening nut is loosened, the coiled spring tension-biased to force the plug away from the assembled position, unless retained in place by the tight fastening nut.

My spool has a number of significant advantages over textile spools presently in use in that no cutting knife or device is required to remove the filament material from the spool, since one end or both end flanges of the spool are easily removed and the filament material may be removed or slid off by hand. Accordingly, there is no damage to the hollow tube through the use of cutting procedures, and the operation is much safer. My improved spool permits the hollow tube to be reused for a significant period of time, and even when damage does occur to the spool, as a whole, only the hollow tube must be replaced, and not the entire spool; therefore, reducing replacement costs. Other advantages will be apparent to those persons skilled in the art from my foregoing description of my improved textile spool.

What I claim is:

1. An improved textile spool adapted to carry a filament material thereon, which spool comprises:

a. a hollow tube adapted to carry a filament material;

b. a first flange at the one end and a second flange at the other end of the hollow tube;

c. a first cylinder at the one end and a second cylinder at the other end of the hollow tube, the cylinders adapted to fit in a slidable, snug relationship within the internal diameter of the hollow tube, at least one of the cylinders characterized by a plurality of slots in the cylinder wall extending generally axially inwardly from one end of the cylinder;

d. a first shaft at the one end and a second shaft at the other end of the hollow tube, the first and second shafts extending axially beyond the first and second flanges, respectively, whereby the extending ends may be placed in a relationship to rotate the hollow tube for a filament winding or unwinding operation;

e. fastening means to secure in an assembled and disassembled position the first and second flange elements with the first and second ends of the hollow tube on the first and second shaft elements; and f. means within the interior of the slotted cylinder to provide for the outward expansion of the slotted end of the cylinder wall against the internal diameter of the hollow tube to secure the cylinder to the hollow tube, when the spool is in an assembled position, and to release the cylinder wall so that the hollow tube may be slidably removable therefrom and placed in a dissambled position through the axial movement of the respective shaft element.

2. The spool of claim 1 wherein the cylinder to be expanded is characterized by a peripheral, internally tapered surface at the one interior end to be expanded, and plug means on the respective shaft is adapted to move into a contacting, expanding relationship with the tapered surface in the assembled position and to move outwardly and into a noncontacting relationship in a disassembled position.

3. The spool of claim 1 wherein the means to provide for expansion of the cylinder includes a plug element on the respective shaft within the cylinder, the plug element characterized by a tapered exterior peripheral surface which is adapted to move in a contacting relationship with the interior peripheral wall of the cylinder at the one end in the assembled position, and away from the cylinder wall in the disassembled position.

4. The spool of claim 3 wherein the cylinder to be expanded is characterized by a plurality of substantially equally spaced axial slots in the cylinder wall at the one end of the cylinder and extending inwardly from the one end toward the other end of the cylinder disposed adjacent the flange.

5. The spool of claim 1 wherein the cylinder to be expanded to the assembled position is characterized by a plurality of substantially equally spaced axial slots in the cylinder wall at the one end, and wherein the means to expand the one end of the cylinder comprises a plug element secured to the end of the respective first or second shaft, the plug element adapted to fit snugly into the one slotted end of the cylinder in the disassembled position, and whereby, on axial inward movement of the plug element against the internal peripheral surface of the cylinder wall at the one end, the one end of the cylinder is slightly expanded to place the spool in the assembled position.

6. The spool of claim 1 which includes:

a. at least one cylinder which is characterized by an interior peripheral surface at a one end interior of the hollow tube which is slightly tapered; and b. a plug element on the shaft within the said cylinder, the plug element having an exterior peripheral tapered surface adapted to mate with the tapered surface of the said cylinder, the taper in the opposite direction from the taper of the cylinder, whereby, on axial movement of the shaft on tightening the fastening means for that shaft, the plug element moves axially toward the respective end of the hollow tube, and expands the end of the cylinder against the internal diameter of the hollow tube to place the spool in an assembled position.

7. The spool of claim 6 which includes a tension means whereby the plug element is tensionally biased to the disassembled position.

8. The spool of claim 7 wherein the tension means is a coiled spring about the shaft and within the said cylinder.

9. The spool of claim 1 wherein the plug element includes a raised key element on the peripheral surface, and the cylinder includes at the one end a slot to receive the key element in the assembled position, so that the plug element will be prevented from turning when in the assembled position.

10. The spool of claim 1 wherein both the first and second cylinders include tapered surface plug elements.

11. The spool of claim 1 wherein the hollow tube comprises a reinforced cardboard tube, the first and second shafts are threaded shaft elements, and the fastening means comprises threaded nuts to fit threadably on the respective shaft elements.

12. An improved textile spool adapted to carry a filament material thereon, which spool comprises:

a. a hollow tube adapted to carry a filament material;

b. a first flange at the one end and a second flange at the other end of the hollow tube;

c. a first cylinder at the one end and a second cylinder at the other end of the hollow tube, the cylinders adapted to fit in a slidable, snug relationship within the internal diameter of the hollow tube;

d. a first shaft at the one end and a second shaft at the other end of the hollow tube, the first and second shafts extending axially beyond the first and second flanges, respectively, whereby the extending ends may be placed in a relationship to rotate the hollow tube for a filament winding or unwinding operation;

e. fastening means to secure in an assembled and disassembled position the first and second flange elements with the first and second ends of the hollow tube on the first and second shaft elements; and f. means to provide for the outward expansion of one end of at least one cylinder to secure the cylinder wall against the internal diameter of the hollow tube, which means comprises a plug element on one end of the respective shaft, with the plug element characterized by a peripheral, exterior, tapered surface, or the one end of the cylinder to be expanded characterized by a peripheral, internal, tapered surface, whereby axial movement of the plug element in the assembled position expands the one end of the cylinder against the internal diameter of the hollow tube, and axial movement in the opposite direction releases the cylinder wall from frictional engagement with the hollow tube so that the hollow tube may be slidably removed from the cylinder.

13. An improved textile spool adapted to carry a filament element thereon, which spool comprises:

a. a hollow tube adapted to carry a filament material;

b. a first flange at the one end and a second flange at the other end of the hollow tube;

c. a first cylinder at the one end and a second cylinder at the other end of the hollow tube, the cylinder elements adapted to fit in a snug relationship within the internal diameter of the hollow tube;

d. a first shaft at the one end and a second shaft at the other end of the hollow tube, the first and second shafts extending axially beyond the flange elements, whereby the extending ends may be placed in a relationship to rotate the hollow tube for a winding or unwinding operation of the filament material thereon;

e. fastening means to secure in an assembled and and disassembled position, the first and second flange elements with the first and second ends of the hollow tube on the first and second shaft elements;

f. at least one of the cylinder elements characterized by being hollow and having a tapered internal surface at the one exterior end thereof within the hollow tube; and g. at least one of the shaft elements having at the one end thereof and extending within the hollow cylinder element a plug element, the plug element characterized by a peripheral tapered exterior surface, which surface is adapted to mate in an engaging relationship with the internal tapered surface of the hollow cylinder, whereby, on axial movement of the plug element through the fastening means to an assembled position, the plug element expands slightly the exterior end of the hollow cylinder to secure the cylinder to the hollow tube, and whereby, on axial movement in the opposite direction of the plug element, the cylinder is released from its expanded condition, whereby the spool may be readily placed in an assembled or a diassembled position by the axial movement of the plug element between an assembled position and a disassembled position.

14. The spool of claim 13 which includes a coiled spring within each cylinder and about the shaft, the spring biased to urge the axial movement of the respective plug elements to the noncontacting disassembled spool position.

15. The spool of claim 13 which includes means to prevent the plug element from turning against the internal wall of the cylinder in the assembled spool position.

16. A method for rapidly placing a textile spool adapted to carry a filament material thereon in an assembled or disassembled position, and wherein the textile spool comprises: a hollow tube adapted to carry a filament material; end flanges at each end of the tube; shaft elements extending outwardly from the end flanges and adapted to place the spool in a filament winding or unwinding position; and cylinder means slidably inserted into each of the hollow tube, the shaft elements extending within the cylinder and secured to the end flanges at each end, which method comprises:

a. expanding the wall diameter of at least one cylinder characterized by a plurality of axially inwardly extending slots in the cylinder wall from the one end thereof to place the slotted segments of the cylinder wall in a holding relationship with the interior wall of the hollow tube and into an assembled position; and b. restoring the slotted segments of the cylinder wall to a smaller diameter to place the cylinder in a condition wherein the hollow tube may be slidably removed from the cylinder and into a disassembled position, the expanding and restoring steps caused by the axial movement of the respective shaft element within the cylinder.

17. The method of claim 16 which includes preventing the shaft elements within the cylinder from turning when the spool is in the assembled position.

18. The method of claim 16 which includes tension-biasing the shaft element within the cylinder to the assembled or disassembled position.

19. The method of claim 16 wherein the expanding is carried out by the axial movement in one direction of one or more tapered contacting surfaces at the one end and within the interior of the cylinder means.

* * * * *